US006858973B2

(12) United States Patent
Nugues et al.

(10) Patent No.: US 6,858,973 B2
(45) Date of Patent: Feb. 22, 2005

(54) COOLING AN ELECTRONIC TUBE

(75) Inventors: Pierre Nugues, St Symphorien le Château (FR); Jean-Paul Nesa, Paris (FR)

(73) Assignee: Thales, Paris (FR)

( * ) Notice: Subject to any disclaimer, the term of this patent is extended or adjusted under 35 U.S.C. 154(b) by 6 days.

(21) Appl. No.: 10/318,362

(22) Filed: Dec. 13, 2002

(65) Prior Publication Data

US 2004/0004423 A1 Jan. 8, 2004

(30) Foreign Application Priority Data

Dec. 14, 2001 (FR) ..... 01 16243

(51) Int. Cl.[7] ..... H01J 1/02
(52) U.S. Cl. ..... 313/37; 313/46; 313/44
(58) Field of Search ..... 313/44, 46, 37

(56) References Cited

U.S. PATENT DOCUMENTS 4,740,657 A * 4/1988 Tsukagoshi et al. ..... 174/88 R
4,985,659 A 1/1991 Tikes et al.
5,004,952 A 4/1991 Iikes et al.
5,021,708 A 6/1991 Nugues et al.
5,083,060 A 1/1992 Nugues et al.
5,132,592 A 7/1992 Nugues et al.
5,288,769 A * 2/1994 Papageorge et al. ..... 523/200
5,834,337 A * 11/1998 Unger et al. ..... 438/122
6,284,817 B1 * 9/2001 Cross et al. ..... 523/220

FOREIGN PATENT DOCUMENTS

DE 2213185 A1 9/1973
DE 2812409 A1 9/1979
DE 3433718 A1 3/1986
JP 54074668 A 6/1979

* cited by examiner

*Primary Examiner*—Vip Patel
*Assistant Examiner*—Anthony Perry
(74) *Attorney, Agent, or Firm*—Lowe Hauptman Gilman & Berner LLP.

(57) ABSTRACT

The invention concerns the electronic amplifier tubes operating at radio-frequency. The electronic tube includes a long tubular sleeve containing an electron beam, a housing supporting the sleeve mechanically, and means to provide heat transfer from the sleeve to the housing to cool the sleeve. The means to provide the heat transfer include a resin filling a free volume located between the sleeve and the housing.

20 Claims, 3 Drawing Sheets

COOLING AN ELECTRONIC TUBE

RELATED APPLICATION

The present application is based on, and claims priority from, French Application No. 01 16243, filed Dec. 14, 2001, the disclosure of which is hereby incorporated by reference herein in its entirety.

The invention concerns the electronic amplifier tubes operating at radio-frequency. It applies more especially to Traveling Wave Tubes (TWT) and it will therefore be described with respect to this type of tube. This type of tube is used, for example, for the transmission of telecommunication signals between the earth and satellites. They are also used as power transmitters in radars.

Briefly, a TWT is a vacuum tube using the principle of interaction between an electron beam and a radio-frequency electromagnetic wave, to transmit some of the energy contained in the electron beam to the radio-frequency wave, so that the radio-frequency wave at the tube output has more energy than the wave injected at the tube input.

FIG. 1 shows the general principle of a TWT. The TWT represented is a helix type TWT, but other types of TWT such as the coupled cavity TWT, the folded wave guide TWT, etc., are all concerned by the invention as well.

TWTs consist of a long tubular sleeve 10 in which the vacuum is produced, with at a first end an electron gun 11 emitting a beam of electrons 12 and at a second end a collector 14; the collector collects the electrons which have given up some of their initial energy to the electromagnetic wave to be amplified. The electron beam 12 is more or less cylindrical for the entire length of the tube between the gun 11 and the collector 14 along an axis 15. This cylindrical beam shape is obtained due to the shape of a cathode 16 of the electron gun 11 (dish-shaped convergent cathode), and magnetic focusing means provided along the entire length of the sleeve 10 between the output of the electron gun 11 and the input of the collector 14. In the electron gun 11, it is the cathode 16 which emits the electron beam 12. These focusing means are permanent circular magnets 18 magnetized axially and alternately from one magnet to the next; these magnets surround the sleeve 10 and are separated from each other by polar parts 20 of high magnetic permeability.

For a helix TWT, the electron beam 12 travels inside a helix shaped conducting structure 22 through which the electromagnetic wave to be amplified is traveling; the radio-frequency energy is amplified due to interaction between this wave and the electron beam 12 passing at its center. The helix is used to slow down the radio-frequency wave, so that its speed, along axis 15 of the electron beam 12, is approximately equal to that of the electron beam 12.

A power signal to be amplified Pe is injected at one end of the helix shaped conducting structure 22 through a plug and a window 24 inside the sleeve 10. An amplified power signal Ps is extracted at the other end of the helix shaped conducting structure 22 via a plug and a window 26.

FIGS. 2 and 3 show in more detail how the sleeve 10 is made as well as the connection of the sleeve 10 with a housing 28 enclosing the entire sleeve 10.

The sleeve 10 as such consists of polar parts 20 and spacers 30 separating the polar parts 20. The spacers 30 are, for example, made from an alloy based on copper and non-magnetic nickel. The outer diameter of the spacers 30 is smaller than that of the polar parts 20, so the magnets 18 whose inner diameter is approximately equal to the outer diameter of the spacers 30 are held between the spacers, for example with resin. The thickness of the spacers 30 measured along axis 15 is approximately equal to the thickness of the magnets 18. The helix 22 is located inside the sleeve 10 and dielectric rods 32 are used to mechanically support the helix inside the sleeve 10. The rods 32 run parallel to axis 15 and, for example, three rods are arranged at 120° to each other around the axis 15. This 120° arrangement of the rods 32 is clearly shown on FIG. 3.

Fins 34 mechanically hold the sleeve 10 inside the housing 28. The fins 34 are also used to evacuate to the housing 28 the heat produced inside the sleeve. The fins 34 are made from metal plates, copper alloy for example. The fins 34 are arranged perpendicular to the axis 15, in contact with the ends of the polar parts 20 and the housing 28.

Summing up, the main functions of the sleeve 10 are:

- maintain a seal between the vacuum inside the sleeve 10 and the external atmosphere;
- hold and align the helix 22 using dielectric rods 32;
- evacuate the heat produced in the electronic tube to the exterior.

This heat is mainly due to:

- the helix 22 which heats due to the effect of bombardment by some badly focused electrons and also to the Joule effect, because of the radio-frequency currents carried;
- the collector 14 which is connected mechanically and therefore thermally to the sleeve 10;
- the electron gun 11 and more especially a cathode and its heating filament.

In an experimental situation, we have observed that the heat given off by the above three parts is distributed as follows:

helix: from 1 to 7%;

collector: from 78 to 84%;

electron gun: 15%.

Due to this distribution, there are more fins 34 fitted around the collector 14 than around the electron gun.

The fins 34 are difficult to produce and assemble. In particular, tight tolerances are required regarding the dimensions of the polar parts 20 and the fins 34 to ensure good mechanical and thermal contact between the polar parts 20, the fins 34 and the housing 28.

The purpose of the invention is to simplify the mechanical securing of the sleeve 10 with respect to the housing 28 whilst ensuring good heat transfer between the sleeve 10 and the housing 28.

The invention therefore concerns an electronic tube with a long tubular sleeve containing an electron beam, a housing supporting the sleeve mechanically, and means to provide heat transfer from the sleeve to the housing to cool the sleeve, wherein the means to provide the heat transfer include a resin filling a free volume located between the sleeve and the housing.

By eliminating the fins 34 described previously, the manufacturing tolerances of the polar parts 20 can be increased. The use of resin also secures mechanically the magnets 18 and, possibly, magnetic correcting shunts which can be attached on the outer walls of the sleeve 10. The role of these shunts is to modify the magnetic field created by the magnets 18 inside the sleeve 10.

In addition, the resin increases the stiffness of the electronic tube mounted in its housing 28.

Eliminating the fins improves the heat dissipation of the sleeve 10 to the housing 28. More precisely, the fins formed localized thermal bridges through which the heat circulated.

By replacing the fins by resin, the heat transfer is no longer localized, it is more uniform. This avoids any hot spots between the fins 34.

The invention will be clearer and other advantages and features will appear on reading the detailed description of a mode of realization given as an example, mode of realization illustrated with reference to the attached drawing in which.

To simplify the remainder of the description, the same elements will bear the same numbers on the various figures.

Figure 1:
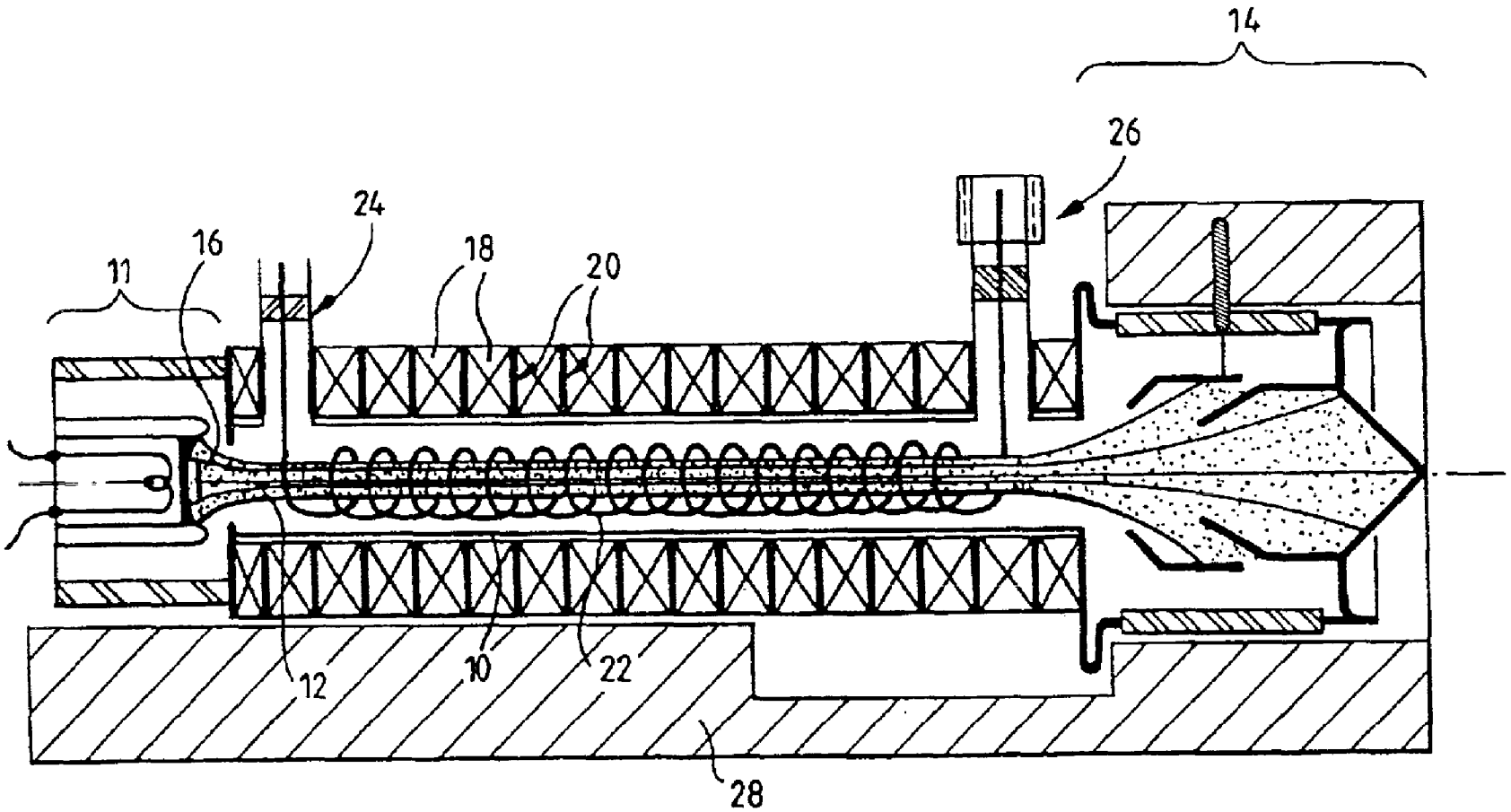
FIG. 1 represents diagrammatically the overall operation of an electronic tube.
Figure 3:
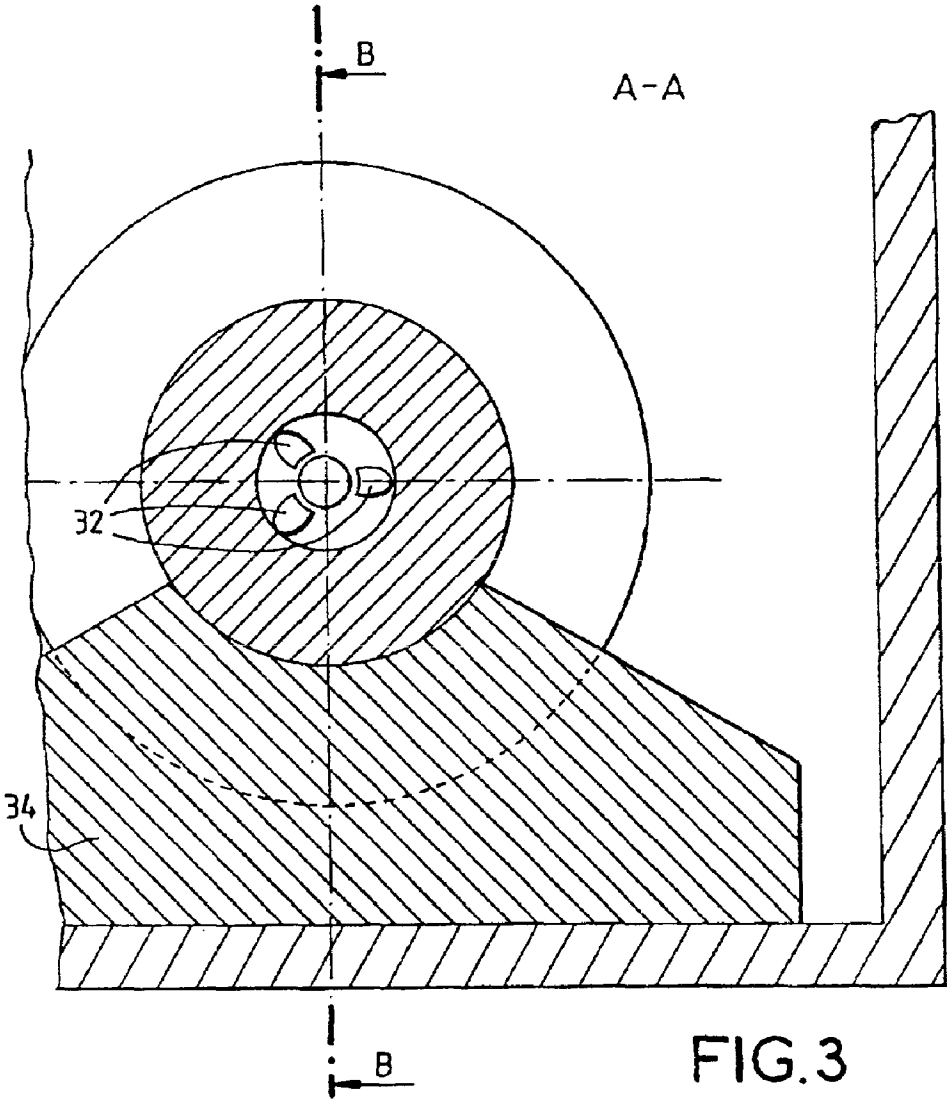
FIG. 3 represents, in cross-section through a plane perpendicular to the axis of the electron beam, a known electronic tube.
Figure 2:
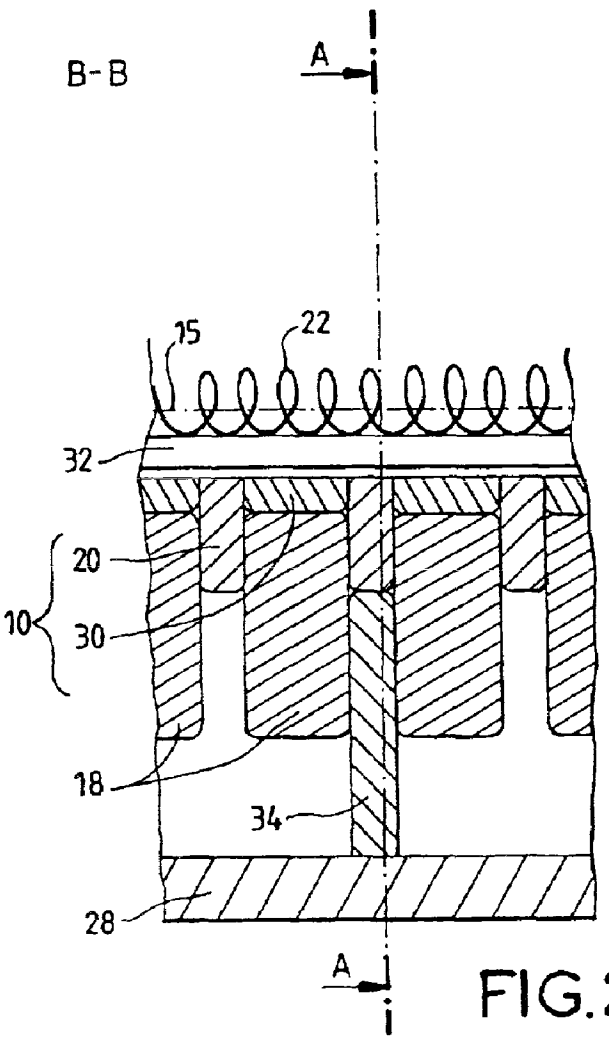
FIG. 2 represents, in cross-section through a plane containing the axis of the electron beam, a known electronic tube.

FIGS. 1 to 3 have already been described above to introduce the invention.

Figure 4:
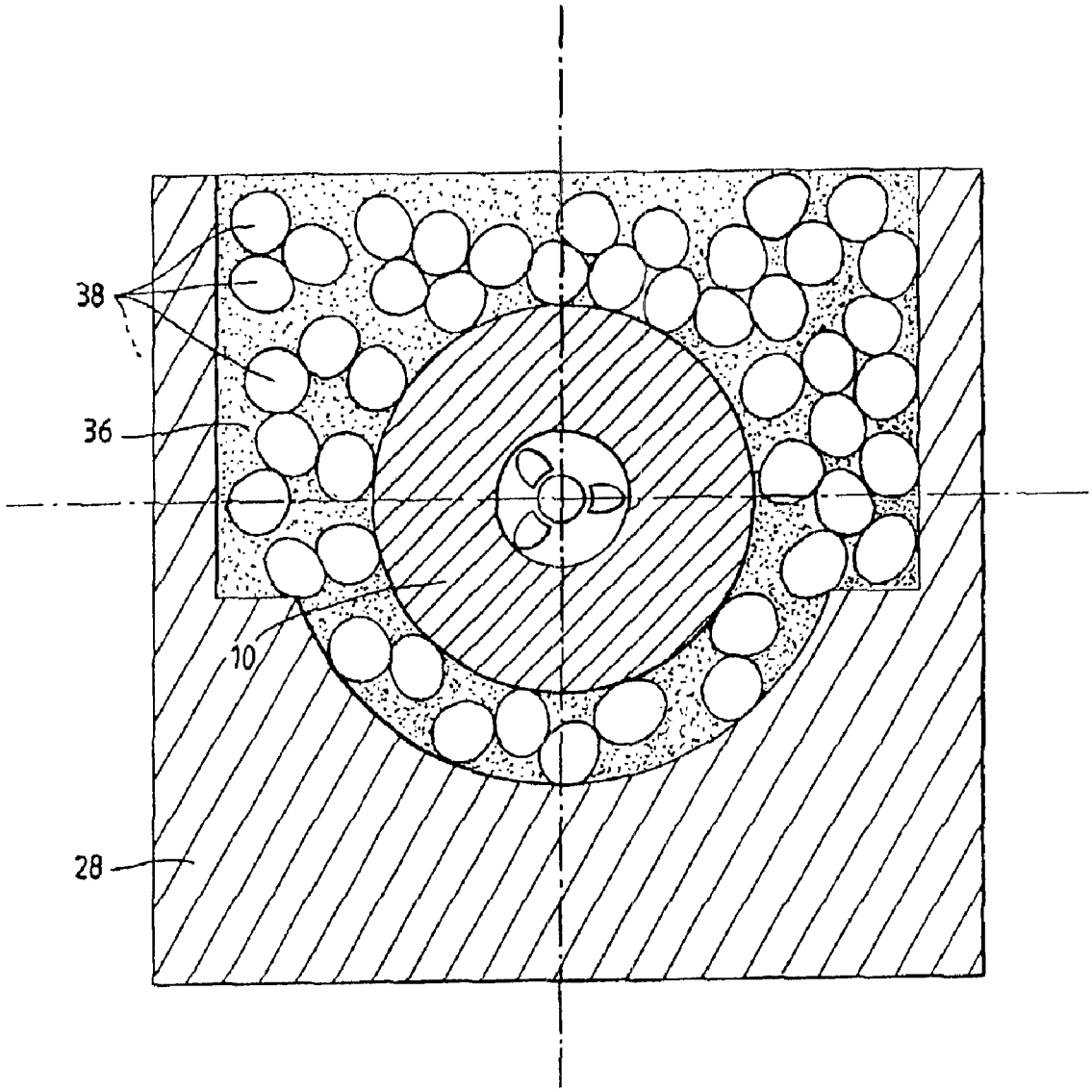
FIG. 4 represents, in cross-section through a plane perpendicular to the axis of the electron beam, an electronic tube according to the invention.

In the electronic tube represented on FIG. 4, the fins 34 have been replaced by a resin 36 filling the free volume located between the sleeve 10 and the housing 28. This resin, once polymerized, mechanically secures the sleeve 10 with respect to the housing 28 and conducts the heat given off inside the electronic tube to the housing 28. A radiator attached to the housing 28 or similar means, not shown on FIG. 4, can be used, for example, to evacuate this heat by a cooling fluid flowing in the radiator. The resin can, for example, be formed from "Stycast 3050" supplied by Emerson and Cuming, to which a suitable catalyst can be added.

Advantageously, granules 38 made from a material whose thermal resistance is less than that of the resin are buried in the resin. These granules improve the heat transfer from the sleeve 10 to the housing 28. Metal granules can be chosen, for example aluminium-based.

Advantageously, the dimensions of the granules 38 are chosen so that a characteristic dimension of these granules 38, for example the diameter if the granules 38 are roughly spherical, is approximately equal to but smaller than the smallest dimension of the free volume left between the sleeve 10 and the housing 28. This characteristic can be seen on FIG. 4 which shows granules that can pass between the lower part of the sleeve 10 and the housing 28. In this region, the larger the granules 38 the better the heat transfer between the sleeve 10 and the housing 28. By increasing the dimensions of the granules 28, in fact, the number of contact regions between the sleeve 10 and the housing 28 passing by the granules is reduced. These contact regions represent the preferred path for the heat. The fewer regions of these there are, the better the heat transfer. It was observed that by using smaller granules or even powder, the thermal conductivity became closer to that of the resin than that of the material forming the powder or the granules. Due to this characteristic dimension as large as possible of the granules 38, it is not essential to choose a resin from amongst those which have good thermal conductivity. This characteristic means that the resin can be chosen freely.

What is claimed is:

1. An electronic tube, comprising:

a long tubular sleeve having an electron gun, a housing supporting the sleeve mechanically, and means to provide heat transfer from the sleeve to the housing to cool the sleeve, wherein the means to provide the heat transfer include a resin filling a free volume located between the sleeve and the housing, wherein the means to provide the heat transfer include granules made from a material whose thermal resistance is less than that of the resin, buried in the resin and wherein a characteristic dimension of the granules is approximately equal to but smaller than the smallest dimension of the free volume.

2. The electronic tube according to claim 1, wherein the material of the granules includes aluminum.

3. The electronic tube of claim 1, wherein the electronic tube is a traveling wave tube (TWT).

4. The electronic tube of claim 3, wherein said TWT is one of a helix type, coupled cavity and a folded waveguide TWT.

5. The electronic tube of claim 1, wherein said sleeve includes polar parts and spacers separating said polar parts.

6. The electronic tube of claim 1, wherein a collector is located at an end of said sleeve to collect a beam of electron emitted by said electron gun.

7. The electronic tube of claim 6, further comprising magnetic focusing means located along the entire length of said sleeve between an output of said electron gun and said collector.

8. The electronic tube of claim 6, further comprising permanent circular magnets surrounding said sleeve.

9. The electronic tube of claim 7, wherein said permanent circular magnets are magnetized axially and alternatively from one magnet to the next.

10. The electronic tube of claim 9, wherein polar parts separate said permanent circular magnets.

11. An electronic tube, comprising:

a long tubular sleeve having an electron gun;

a housing supporting the sleeve mechanically wherein a void is formed between said sleeve and said housing;

a resin tilling said void including granules made from a material whose thermal resistance is less than that of the resin and wherein a characteristic dimension of the granules is approximately equal to but smaller than the smallest dimension of the free volume.

12. The electronic tube of claim 11, wherein the material of the granules includes aluminum.

13. The electronic tube of claim 11, wherein the electronic tube is a traveling wave tube (TWT).

14. The electronic tube of claim 13, wherein said TWT is one of a helix type, coupled cavity and a folded waveguide TWT.

15. The electronic tube of claim 11, wherein said sleeve includes polar parts and spacers separating said polar parts.

16. The electronic tube of claim 15, wherein a collector is located at an end of said sleeve to collect a beam of electron emitted by said electron gun.

17. The electronic tube of claim 16, further comprising magnetic focusing means located along the entire length of said sleeve between an output of said electron gun and said collector.

18. The electronic tube of claim 16, further comprising permanent circular magnets surrounding said sleeve.

19. The electronic tube of claim 17, wherein said permanent circular magnets are magnetized axially and alternatively from one magnet to the next.

20. The electronic tube of claim 19, wherein polar parts separate said permanent circular magnets.

* * * * *